US009518422B2

(12) United States Patent
Noble, III

(10) Patent No.: US 9,518,422 B2
(45) **Date of Patent: *Dec. 13, 2016**

(54) FIRE DOOR STOP SYSTEM

(71) Applicant: Charles A. Noble, III, Sanford, ME (US)

(72) Inventor: Charles A. Noble, III, Sanford, ME (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/830,350

(22) Filed: Aug. 19, 2015

(65) Prior Publication Data

US 2015/0354267 A1 Dec. 10, 2015

Related U.S. Application Data

(63) Continuation-in-part of application No. 14/211,008, filed on Mar. 14, 2014, now Pat. No. 9,151,106.

(60) Provisional application No. 61/788,542, filed on Mar. 15, 2013.

(51) Int. Cl.

| | |
|---|---|
| ***E06B 7/16*** | (2006.01) |
| ***E06B 5/16*** | (2006.01) |
| ***E06B 1/70*** | (2006.01) |
| *E06B 3/88* | (2006.01) |

(52) U.S. Cl.

CPC ..... *E06B 5/164* (2013.01); *E06B 1/70* (2013.01); *E06B 5/161* (2013.01); *E06B 3/88* (2013.01); *E06B 2001/707* (2013.01)

(58) Field of Classification Search

CPC ..... E06B 1/161; E06B 1/164; E06B 3/88; E06B 2001/707

USPC ..... 52/232

See application file for complete search history.

(56) References Cited

U.S. PATENT DOCUMENTS

| | | | |
|---|---|---|---|
| 3,130,455 | A | 4/1964 | Borlenghi |
| 3,566,541 | A | 3/1971 | Coulter |
| 4,001,974 | A | 1/1977 | Wright |
| 4,281,481 | A | 8/1981 | Wendt |
| 4,748,771 | A | 6/1988 | Lehnert et al. |
| 4,888,918 | A | 12/1989 | Green et al. |
| 5,203,130 | A | 4/1993 | Freelove |
| 5,214,880 | A | 6/1993 | Woodruff et al. |
| 5,230,180 | A | 7/1993 | Tweedt et al. |
| 5,355,625 | A | 10/1994 | Matsuoka |
| 5,669,192 | A | 9/1997 | Opdyke et al. |
| 5,836,118 | A | 11/1998 | Thornton et al. |
| 6,088,966 | A | 7/2000 | Kenkel |
| 6,170,210 | B1 | 1/2001 | Marts |
| 6,374,545 | B1 | 4/2002 | Baczuk |
| 6,478,308 | B1 | 11/2002 | McMillin et al. |
| 6,668,499 | B2 | 12/2003 | Degelsegger |
| 6,826,877 | B1 | 12/2004 | Stradel |
| 7,204,059 | B2 | 4/2007 | Schiffmann et al. |

(Continued)

FOREIGN PATENT DOCUMENTS

GB EP 0509701 A1 * 10/1992 ..... E06B 5/164

*Primary Examiner* — Beth Stephan

(74) *Attorney, Agent, or Firm* — Lando & Anastasi, LLP

(57) ABSTRACT

A fire door stop system for retrofitting a fire door assembly so as to bring the assembly into compliance with fire safety codes. The fire door stop system has a profile strip includes at least one flange and intumescent seal that is attachable to a fire door frame. The fire door stop system further includes, as needed, edge protectors for a wood fire door, such as a horizontal edge protector, a vertical edge protector, and a bottom-edge extender, and a latch protector.

19 Claims, 6 Drawing Sheets

(56) References Cited

U.S. PATENT DOCUMENTS

| | | | | |
|---|---|---|---|---|
| 2004/0221527 | A1 | 11/2004 | Sykora | |
| 2005/0268559 | A1 | 12/2005 | Ellingson | |
| 2006/0179905 | A1 | 8/2006 | Killins | |
| 2007/0261312 | A1 | 11/2007 | Kuppler | |
| 2009/0241465 | A1 | 10/2009 | Majors | |
| 2011/0095548 | A1 | 4/2011 | Weinraub | |
| 2011/0203251 | A1* | 8/2011 | Mayes | C23C 4/185 60/39.091 |
| 2011/0283627 | A1 | 11/2011 | Shaw | |

* cited by examiner

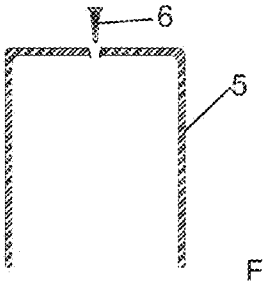
FIG. 8
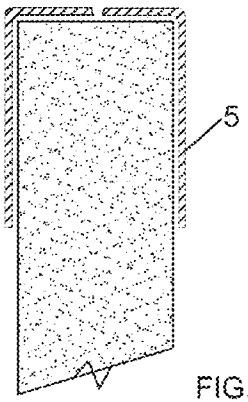
FIG. 12
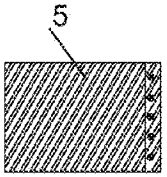
FIG. 11
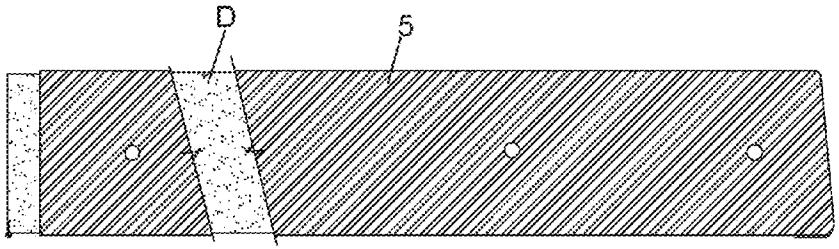
FIG. 7
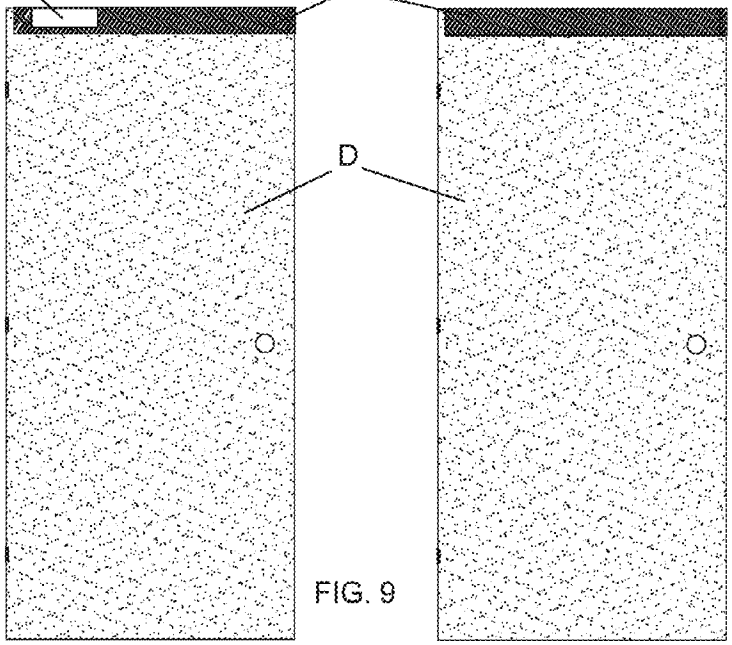
FIG. 10
FIG. 9

FIRE DOOR STOP SYSTEM

RELATED APPLICATIONS

This application is a continuation-in-part of and claims priority under 35 U.S.C. §120 to U.S. patent application Ser. No. 14/211,008, entitled "FIRE DOOR STOP SYSTEM," filed Mar. 14, 2014. This application claims priority under 35 U.S.C. §119(e) to U.S. Provisional Application Ser. No. 61/788,542, entitled "FIRE DOOR STOP," filed on Mar. 15, 2013 which is herein incorporated by reference in its entirety.

FIELD OF THE INVENTION

The invention relates to fire doors. More particularly, the invention relates to afire door stop to stop the spread of smoke, hot gases, or fire from flowing between a fire door and the door frame.

DISCUSSION OF THE RELATED ART

The National Fire Protection Association (NFPA) develops codes and standards that minimize the risk and effects of fire and other hazardous situations. NFPA 80 regulates the installation and maintenance of assemblies and devices used to protect openings in walls, floors, and ceilings and as of 2007 requires that all doors and door frames that are labeled fire doors and labeled fire door frames be inspected and tested annually. This standard is herein incorporated in its entirety by reference. NFPA 80 specifies the allowable clearances or gaps between fire door and frame and the floor. Currently, the specified clearance between door and frame is ⅛ inch, plus or minus 1/16 inch, for steel doors, and shall not exceed ⅛ inch for wood doors. The clearance between the bottom of the fire door and the floor shall be a maximum of ¾ inch.

Precise standards regulating fire doors exist to ensure that a fire door assembly, which includes a fire door and a fire door frame with door frame, functions as desired to stop the flow of fire, hot gases, and smoke. The standards require that the fire door assembly, i.e., the labeled door frame and the labeled fire door, be built to a specified size and then be installed, such that about ½ inch of the edge of the door overlaps the soffit height of the frame, which is typically ⅝ inch deep, thereby creating an overlap interface between fire door and door frame. The specified clearance between door and frame is ⅛ inch, plus/minus 1/16 inch for steel doors, and shall not exceed ⅛ inch for wood doors. Clearances are always measured from the pull face of the door. This overlap is necessary in a fire condition to keep the fire door in place and together, when afire hose water stream is put onto the fire door, and to hold back the fire, hot gases, and smoke, and also to allow for shrinkage in wood doors, as the wood edges burn away in afire condition.

Unfortunately, the doors and door frames are built to the minimum standards and, if the installation isn't perfect, the clearance between the edge of the labeled fire door and the labeled door frame may be excessive, such that the overlap is less than specified or that a gap exists between the edge of the door and the edge of the frame. There are an estimated 150 million fire doors installed in the US today and 80% of them fail a first-time inspection. The overwhelming majority of the failures are due to excessive clearance between door and door frame. Typically, the excessive clearance is ¼ to 5/16 inch wide, with some clearances as large as ½ inch.

Also, buildings settle over the years, increasing imperfections in the installation and contributing to the formation of an excessive clearance. The remedy is to shim the door frame to eliminate the excessive clearance, or to replace the door and frame altogether. Replacing the door and/or frame is not only costly, but may be nearly impossible. In many commercial building, including hospitals and schools, the fire door frames are embedded in concrete as the building is constructed. Even the less invasive remedy of shimming the door frame can be impossible in this case. If it is possible to shim the door, this means pulling the door from the hinge side toward the lock side, which then frequently creates an excessive clearance on the hinge side.

What is needed, therefore, is a simple, reliable means of eliminating a gap between a labeled fire door and labeled fire door frame, even when both door and frame have been built to minimum standards.

BRIEF SUMMARY OF THE INVENTION

The disclosure is directed to a fire door stop system for use on steel or wood fire door assemblies. The fire door stop system according to the disclosure, also referred to as a fire door stop system is installed on door labeled fire door frames of labeled fire door assemblies and increases the overlap between the fire door and the door frame. The fire door stop system according to the disclosure corrects excessive clearances on fire door assemblies, which would otherwise fail a safety inspection and void the label on the labeled fire door assembly, and brings them into compliance with the fire safety codes.

The door stop according to the disclosure is a profile strip made of 16 to 20 gauge steel with a strip of intumescent sealant that is applied to the profile. The sealant expands with heat, to seal out gases, air, flame, and/or smoke. The overlap of the door with the frame ensures that the fire door is capable of withstanding the typical hose stream pressure, which presses the door against the door stop.

Wood fire doors have wood edges that burn out within minutes in a fire condition, in some cases, leaving no edge to interface with the door frame. These edges require added fire protection along the horizontal edge and/or the vertical edge of the door when clearances are excessive. The fire door stop system according to the disclosure includes additional profiles for protecting these edges.

A latch protector may also be provided, for use with steel or wood fire doors, to ensure that the bolt extends far enough into the striker plate to properly engage the latch.

The fire door stop system according to the disclosure, i.e., the fire door stop and, as needed, the edge protectors, latch protector, and the fire-door extension, guarantees proper performance of the fire door, which is an integral part of a life-safety protection system. The fire door stop system accommodates the typical business practice of manufacturing to minimum standards and imperfections in manufacturing and installation.

BRIEF DESCRIPTION OF THE DRAWINGS

The present invention is described with reference to the accompanying drawings. In the drawings, like reference numbers indicate identical or functionally similar elements. The drawings are not drawn to scale.

FIG. 7 illustrates a top edge protector on a door.

FIG. 8 illustrates details of the top edge protector.

FIG. 9 illustrates the rear face of a door with the top edge protector attached.

FIG. 10 illustrates the front face of a door with the top edge protector attached.

FIG. 11 illustrates a method of wrapping the top edge protector around the edge of the door.

FIG. 12 is a cross-sectional view of the top portion of a door, showing the top edge protector placed over the top edge of the door.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
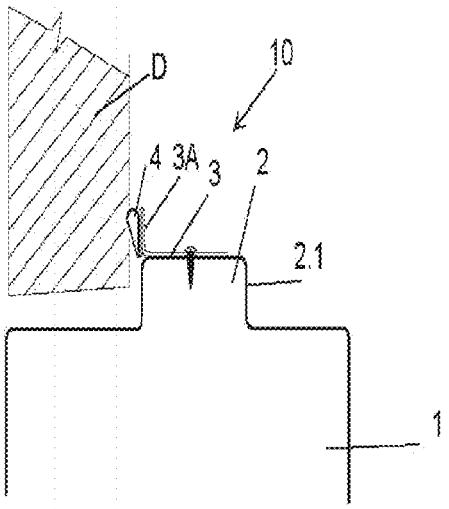
FIG. 1 is a top plan partial illustration of the fire door stop system according to the disclosure.

FIGS. 1-6 illustrate a fire door stop system 10 according to the disclosure that is used with afire door assembly, to ensure that the assembly remains compliant with fire safety codes. A fire door assembly that is compliant includes a labeled fire door D and a labeled fire door frame 1. FIG. 1 shows a partial section of a fire door assembly, i.e., a conventional labeled fire door D and a conventional labeled fire door frame 1 with a soffit 2. The door D is closed. The soffit 2 has a standard soffit height 2.1 of ⅝ inch. As shown in the figure, there is a gap between the door D and the soffit 2. The fire door stop system 10 comprises a profile strip 3 and an intumescent sealer 4 that is mountable on the profile strip 2, to provide a seal between the fire door D and the profile strip 3. The profile strip 3 has a flange 3A that extends the soffit height of the soffit 2 out from the door frame 1, thereby providing a greater "overlap" area of the edge of the door against the soffit 2.

Figure 2:
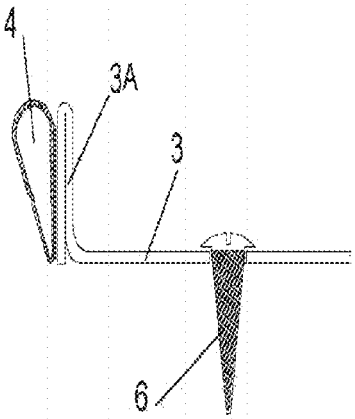
FIG. 2 illustrates details of one embodiment of the fire door stop system profile strip and intumescent sealer.
Figure 3:
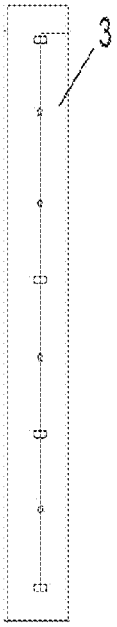
FIG. 3 is an elevation view of the profile strip attached.

FIGS. 2 and 3 show details of the profile strip 3. The profile strip 3 is a flat strip of steel, preferably 22 gauge steel, that is folded to create the flange 3A. Bores or dimples may be provided at intervals along the face of the strip, to facilitate fastening the strip 3 to the vertical edge of the door D. Fasteners 6 used to attached the profile strip 3 to the door D are preferably flat head Phillips screws, steel, zinc plated.

The intumescent sealer 4 is any suitable sealer, such as the intumescent fire, smoke, and draft gasket commercially available as Zero FS-488 or Loreint product number ES99.

The fire door stop system 10 is applied to areas of excessive clearance that frequently occur between the fire door D and the door frame 1, i.e., between the vertical edge of the fire door D that closes against the door frame 2 and, as needed, between the top of the fire door D and the fire door frame 2 and between the bottom of the fire door D and the finished floor. Normally, with steel fire doors, the fire door stop system 10 as described above is sufficient to ensure that the fire door assembly satisfies the fire safety code.

Wood fire doors need added edge protection, because the wood edges, if not protected, may burn out within minutes in a fire condition, leaving little interface between the fire door and the fire door frame. Steel fire doors do not need this edge protection, because steel doesn't burn out or shrink in a fire condition. For this reason, the door stop system 10 includes a horizontal edge protector 5, a vertical edge protector 9, and a bottom-edge extender 7.

Figure 4:
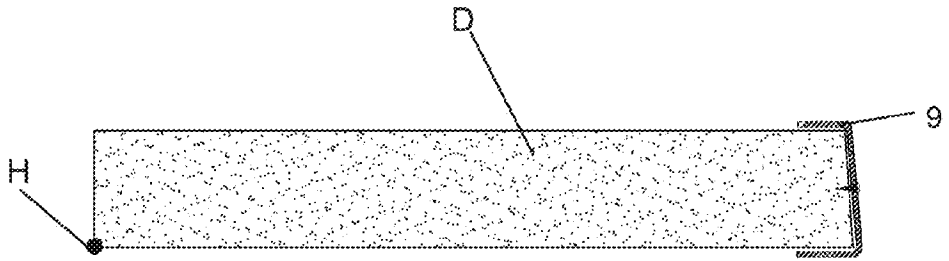
FIG. 4 is a plan view of the top edge of a door, showing a vertical edge protector attached.
Figure 5:
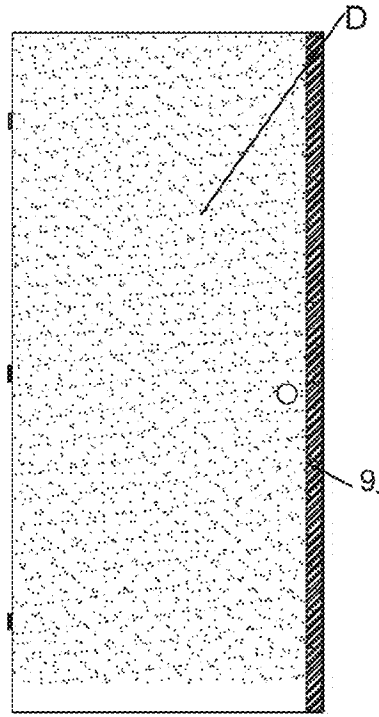
FIG. 5 is an elevation view of a front face of a door, showing the vertical edge protector attached.
Figure 6:
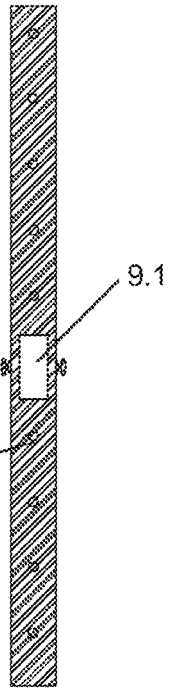
FIG. 6 is an elevation view of the pull edge of a door, showing the vertical edge protector attached.
Figure 14:
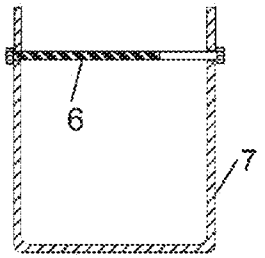
FIG. 14 illustrates details of the bottom extension.
Figure 15:
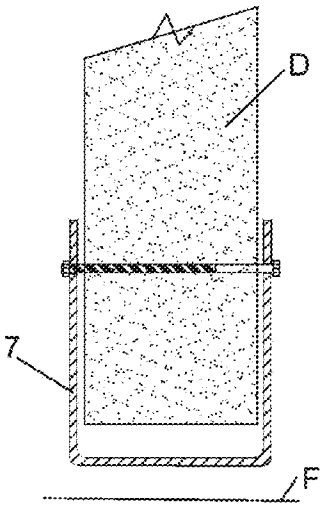
FIG. 15 shows the bottom extension fastened to the bottom edge of a door.

FIGS. 4-6 illustrate a vertical edge protector 9 for the fire door D that is wrapped around the vertical edge of the door. A cut-out 9.1 is provided, to accommodate a door latch.

FIGS. 7-12 show the horizontal edge protector 5. This protector is made of the same material as the profile strip 3 and may be cut to fit the edge of the door D, whereby care must be taken to be sure there are no sharp or protruding edges. This optional edge protectors 5 is not needed for fire-rated steel or steel-composite doors. The horizontal edge protector 5 is a profile that is wrapped around the top edge of the door D. FIG. 8 illustrates details of the protector 5 with fastener 6 and FIGS. 9-11 illustrate how the edge protector 5 is fitted on the door.

Figure 18:
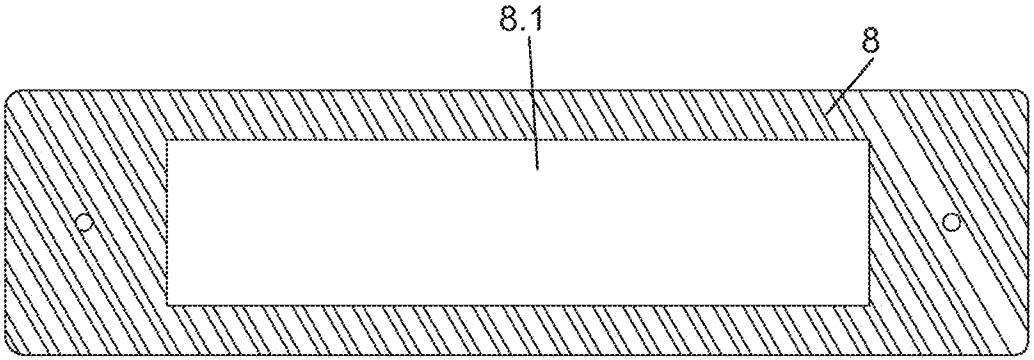
FIG. 18 illustrates a latch protector that is used with a fire door.

FIG. 18 illustrates a latch protector 8, which may be used on wood fire doors and steel fire doors, as need. The bolt for the latch on the door lock has to extend into the striker plate at least ½ inch for proper latch engagement and in order to be compliant with the fire safety code. The latch protector 8 is a plate that is mounted on the closing edge of the door frame 1 behind the striker plate, which moves the striker plate out closer to the edge of the door. This, of course, reduces the clearance between the striker plate and the door and allows the latch to penetrate farther into the striker plate, bringing the door into compliance with the safety code.

Figure 13:
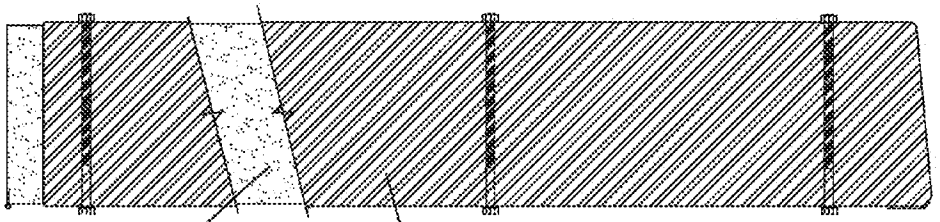
FIG. 13 is a plan view of the bottom edge of a door, with the bottom extension attached to the door.
Figure 16:
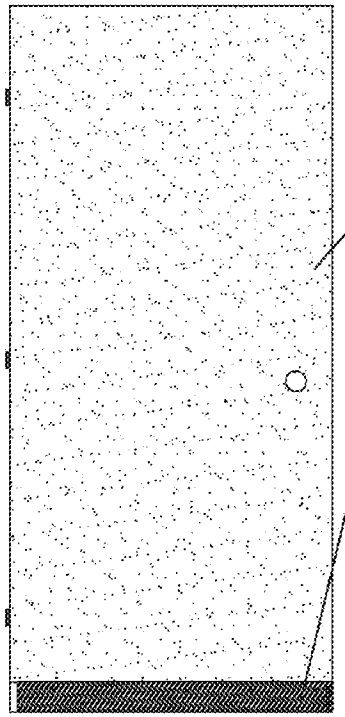
FIG. 16 is a plan elevation view of the front face of a door, showing the bottom extension attached.
Figure 17:
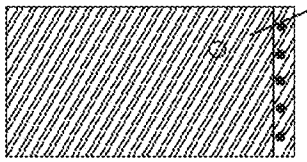
FIG. 17 illustrates a method of wrapping the bottom extension around the bottom edge of the door.

FIG. 13-17 illustrate the bottom-edge extender 7 that may be used in conjunction with the fire door stop system 10 according to the disclosure. According to the fire safety code, the bottom edge of a fire door has to be with a certain distance of the floor, i.e., within ¾ inch or closer to the finished floor. Often, the gap between the bottom of the door and the floor is greater than the distance specified by the safety code. This bottom-edge extender 7 may be attached to the bottom edge of a finished fire door and so mounted on the door, that the lower edge of the extender is the proper distance from the finished floor, thereby bringing the labeled fire door into compliance with the code. The extender 7 is so constructed, that doors with a clearance of up to two inches may be extended downward to meet the requirement and be brought into compliance with the fire safety code. FIG. 13 is a plan view of the bottom of a door, with the bottom extension 7 attached and FIG. 15 particularly shows how the bottom extension 7 is used to reduce the gap between the bottom edge of the door D and the floor F.

Figure 19:
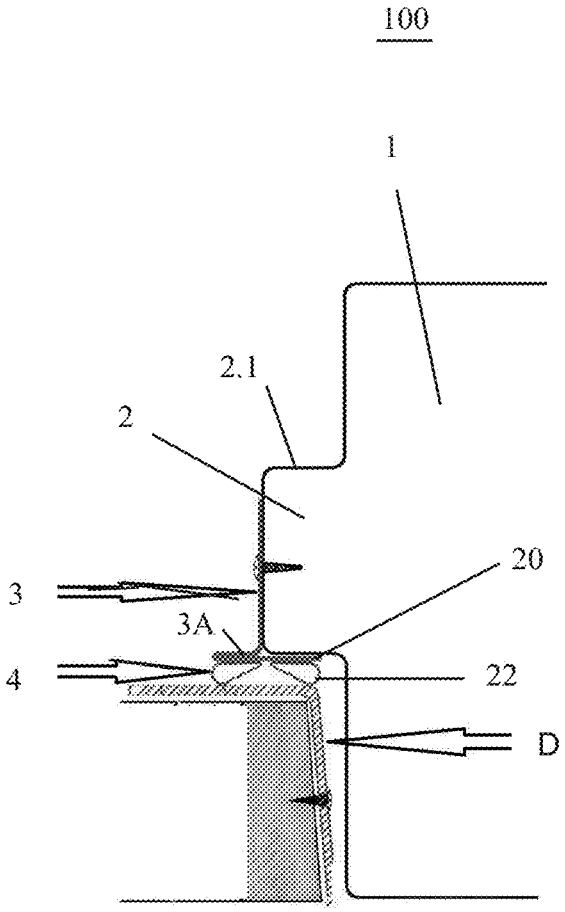
FIG. 19 illustrates details of another embodiment of the fire door stop system profile strip and intumescent sealer.

FIG. 19 illustrates another embodiment of a fire door stop system 100 according to the disclosure that is used with a fire door assembly, to ensure that the fire door assembly remains compliant with fire safety codes. In particular, it is appreciated that this embodiment can be used with a Category B wood veneer fire door assembly, to ensure that the fire door assembly remains compliant with fire safety codes. Reference is made to FIGS. 1-2, wherein like reference numerals correspond to the structure illustrated in FIGS. 1-2. As noted previously, the fire door assembly includes a labeled fire door D and a labeled fire door frame 1. FIG. 1 shows a partial section of the fire door assembly, i.e. a conventional labeled fire door D and a conventional labeled fire door frame 1 with a soffit 2. The door D is closed. The soffit 2 has a standard soffit height 2.1 of ⅝ inch. As shown in FIG. 1, there is a gap between the door D and the soffit 2. Referring to FIG. 19, this embodiment of the fire door stop system 100 comprises a profile strip 3 having a first flange 3A and a first seal 4 made of an intumescent material to form a first intumescent seal 4 that is mountable on the first face of the first flange 3A of the profile strip 3, to provide a first seal between the fire door D and the profile strip 3. The first flange 3A extends the soffit height of the soffit 2 out from the door frame 1, thereby providing a greater "overlap" area of the edge of the door against the soffit 2. The profile strip 3 further comprises a second flange 20 and a second seal 22 made of an intumescent material to form a second intumescent seal 22 that is mountable on the second face of the second flange 20 of the profile strip 3, to provide a second seal between the fire door D and the profile strip 3. The second flange 20 extends inward toward the fire door frame and overlaps the fire door stop surface 2.1, thereby providing an additional "overlap" sealed surface between the edge of the door and the soffit 2. It is appreciated that this embodiment of the fire door system has been tested and shown to bring non-compliant Category B wood veneer fire door assemblies into compliance, has passed certain testing described herein to ensure that a non-compliant Category B wood veneer fire door assembly remains compliant with fire safety codes.

It is appreciated that according to aspects of embodiments of the fire door system of this disclosure, the profile strip is configured to remedy non-compliant fire doors and fire door frames having clearances greater than 3⁄16" for steel doors and greater than ⅛" for wood doors. It is appreciated that according to aspects of other embodiments of the fire door system of this disclosure, the profile strip is configured to remedy non-compliant fire doors and fire door frames having clearances up to ½" for steel doors and up to ⅜" for wood doors.

As noted herein, the fire door stop system remedies non-compliant fire doors and fire door frames. For the fire door system to be certified by the Underwriters Laborator (UL), the fire door system has to comply with certain industry standards. In particular, the fire door stop system to be certified must comply with NFPA 252 Standard Methods of Fire Tests of Door Assemblies. It is noted that the various embodiments of the fire door system of this disclosure have been certified by UL to comply with this industry standard as early as March 2013. In particular, embodiments of the fire door stop system as disclosed herein have been tested and shown to maintain structural integrity of wood doors when subjected to a fire test for at least 90 minutes for temperatures of at least 1700° F. in addition, embodiments of the fire door stop system as disclosed herein have been tested and shown to maintain structural integrity of steel doors when subjected to a fire test for at least 180 minutes for temperatures of at least 1900° F. The UL test further requires such fire door structures to maintain structural integrity immediately after the fire test under impact, erosion, rapid cooling and thermal shock effects of a stream of water emitted from a hose discharging water from a 1 and ⅛" tip under pressure to produce a 57.2 lb force for up to a minute. It is noted that embodiments of the fire door stop system have been tested and shown to comply with the stream of water test after being subjected to both wood doors when subjected to a fire test for or at least 90 minutes for temperatures of at least 1700° F., and steel doors when subjected to a fire test for at least 180 minutes for temperatures of at least 1900° F. Thus, it is noted that the embodiments of the fire door stop system have been tested by UL labs as early as March 2013, and have passed industry certification requirements for both wood fire doors and steel fire doors.

It is appreciated that embodiments of the fire door stop system according to the disclosure does not increase or decrease the rating of the fire door assembly itself, but instead bring non-compliant fire door assemblies into compliance so that the fire door assemblies pass certain testing described herein to ensure that a non-compliant fire door assemblies remains compliant with fire safety codes.

It is understood that the embodiments described herein are merely illustrative of the present invention. Variations in the construction of the fire door stop system may be contemplated by one skilled in the art without limiting the intended scope of the invention herein disclosed.

What is claimed is:

1. A fire door stop system used with a fire door assembly that includes a fire door and a fire door frame having a soffit that forms an overlap surface between the fire door and the fire door frame, the fire door stop system configured to remedy non-compliant clearances between the fire door and fire door frame that are not compliant with fire safety standards comprising:

a profile strip that is configured to be fastenable to the soffit; and a first seal consisting of an intumescent material sealer to form a first intumescent seal;

wherein the profile strip has a first flange that, when fastened to the soffit, extends outward from the soffit so as to form an extended overlap surface between the fire door and the fire door frame, the first flange having a first face surface that faces the fire door; and wherein the first intumescent seal is affixed to the first face surface of the first flange so as to forma first seal against the fire door under non-fire conditions when the fire door is closed.

2. The fire door stop system of claim 1, wherein the soffit has a fire door stop surface against which the fire door closes, wherein the profile strip further comprises a second flange that, when fastened to the soffit, extends inward against the fire door stop surface so as to form a second overlap surface between the fire door and the fire door frame, the second flange having a second face surface that faces the fire door; a second seal consisting of an intumescent material sealer to form a second intumescent seal; and wherein the second intumescent seal is affixed to the second face surface of the second flange so as to form a second seal against the fire door under non-fire conditions when the fire door is closed.

3. The fire door stop system as claimed in claim 1, wherein the profile strip is configured to remedy non-compliant fire doors and fire door frames having clearances greater than 3⁄16" for steel doors and greater than ⅛" for wood doors.

4. The fire door stop system as claimed in claim 3, wherein the fire door stop system is configured to maintain a minimum fire resistance rating with a wood door when subjected to a fire test for at least 90 minutes for temperatures of at least 1700° F.

5. The fire door stop system as claimed in claim 4, wherein the fire door stop system is configured to maintain a minimum fire resistance rating immediately after the fire test under impact, erosion, rapid cooling and thermal shock effects of a stream of water emitted from a hose discharging water from a 1 and ⅛" tip under pressure to produce a 57.2 lb force for up to a minute.

6. The fire door stop system as claimed in claim 3, wherein the fire door stop system is configured to maintain a minimum fire resistance rating with a steel door when subjected to a fire test for at least 180 minutes for temperatures of at least 1900° F.

7. The fire door stop system as claimed in claim 6, wherein the fire door stop system is configured to maintain a minimum fire resistance rating immediately after the fire test under impact, erosion, rapid cooling and thermal shock effects of a stream of water emitted from a hose discharging water from a 1 and ⅛" tip under pressure to produce a 57.2 lb force for up to a minute.

8. The fire door stop system as claimed in claim 1, wherein the profile strip is configured to remedy non-compliant fire doors and fire door frames having clearances up to ½" for steel doors and up to ⅜" for wood doors.

9. The fire door stop system as claimed in claim 8, wherein the fire door stop system is configured to maintain a minimum fire resistance rating with a wood door when subjected to a fire test for at least 90 minutes for temperatures of at least 1700° F.

10. The fire door stop system as claimed in claim 9, wherein the fire door stop system is configured to maintain a minimum fire resistance rating immediately after the fire test under impact, erosion, rapid cooling and thermal shock effects of a stream of water emitted from a hose discharging water from a 1 and ⅛" tip under pressure to produce a 57.2 lb force for up to a minute.

11. The fire door stop system as claimed in claim 8, wherein the fire door stop system is configured to maintain a minimum fire resistance rating with a steel door when subjected to a fire test for at least 180 minutes for temperatures of at least 1900° F.

12. The fire door stop system as claimed in claim 11, wherein the fire door stop system is configured to maintain a minimum fire resistance rating immediately after the fire test under impact, erosion, rapid cooling and thermal shock effects of a stream of water emitted from a hose discharging water from a 1 and ⅛" tip under pressure to produce a 57.2 lb force for up to a minute.

13. The fire door stop system of claim 1, wherein the profile strip is constructed of 22 gauge steel.

14. The fire door stop system of claim 1, further comprising a horizontal edge protector, wherein the fire door has a front face, a rear face, and a horizontal edge face at a top and at a bottom of the fire door, and wherein the horizontal edge protector has a three-sided channel shape that fits over the horizontal edge face and extends a distance onto the front face and the rear face, so as to protect the horizontal edge face at the top and/or the bottom of the fire door.

15. The fire door stop system of claim 14, wherein the horizontal edge protector is a bottom-edge extension that is fastenable to a bottom edge of the fire door and is adjustable in its placement on the bottom edge of the fire door, so as to reduce a gap between the bottom edge of the fire door and a finished floor surface.

16. The fire door stop system as claimed in claim 15, wherein the horizontal edge protector is configured to correct excessive clearances between the bottom edge of the door and the floor of greater than ¾".

17. The fire door stop system as claimed in claim 15, wherein the horizontal edge protector is configured to correct excessive clearances between the bottom edge of the door and the floor of up to 2".

18. The fire door stop system of claim 1, further comprising a latch protector that is a steel plate with a cutout dimensioned to accommodate dimensions of a striker plate opening that is provided on a striker plate that is mountable on the fire door frame, wherein the latch protector is mountable between the striker plate and the fire door frame.

19. The fire door stop system of claim 1, further comprising a vertical edge protector, wherein the fire door has a front face, a rear face, and a vertical edge face along each side of the fire door, and wherein the vertical edge protector is wrapped around the vertical edge face of at least one side of the fire door.

* * * * *